United States Patent [19]

Morita

[11] 4,344,611

[45] Aug. 17, 1982

[54] DEVICE FOR FEEDING PLATE MATERIALS

[75] Inventor: Shigeru Morita, Saitama, Japan

[73] Assignee: Nippon Flute Co., Ltd., Tokyo, Japan

[21] Appl. No.: 200,402

[22] Filed: Oct. 24, 1980

[30] Foreign Application Priority Data

Jun. 26, 1980 [JP] Japan ..... 55/86797

[51] Int. Cl.[3] ..... B65H 1/08

[52] U.S. Cl. ..... 271/129; 271/135

[58] Field of Search ..... 271/42, 129, 131, 134, 271/135, 137, 138

[56] References Cited

U.S. PATENT DOCUMENTS

| | | | |
|---|---|---|---|
| 1,281,014 | 10/1918 | Huneke | 271/135 |
| 1,644,695 | 10/1927 | Sieg | 271/135 |
| 2,646,279 | 7/1953 | Thomas | 271/42 |
| 2,844,371 | 7/1958 | Rowlands | 271/135 |
| 3,335,699 | 8/1967 | Aiken | 271/138 X |

*Primary Examiner*—Richard A. Schacher

*Attorney, Agent, or Firm*—James E. Nilles

[57] ABSTRACT

A device for feeding plate materials wherein plate materials in a magazine are guided toward its outlet and urged in the direction perpendicular to their surfaces by a reciprocating member disposed at the outlet of the magazine in such a manner that it can be moved back and forth to receive the plate members from the outlet of the magazine and carry them one by one on its support surface to a predetermined position. A kicker is retractably fitted to the reciprocating member through a spring so that, when projected from the support surface of the reciprocating member, the kicker engages with the rear edge of the plate material on the support surface as it advances. A rear engagement projection protrudes inwardly from the rear wall of the magazine outlet so that it opposes and engages the outer rear surface of the outermost one of the plate materials contained in the magazine. A front engagement projection protrudes from the front wall of the magazine outlet toward the support surface of the reciprocating member so that it opposes the front edge of the outermost one of the plate materials contained in the magazine. A claw projects from the front end of the kicker so that it catches the rear edge of the plate material pressed against the support surface of the reciprocating member.

4 Claims, 14 Drawing Figures

6
10
16
14
2a
9
13
28
29
4
15
17
1
2

6
2a
9
28
29
4
30
31
32
33
14
10
34
13
1
2
15
17

DEVICE FOR FEEDING PLATE MATERIALS

BACKGROUND OF THE INVENTION

1. Field of the Invention:

This invention relates to a device for feeding plate materials.

2. Description of the Prior Art:

In producing corrugated cardboard boxes in quantity, a series of foldable cardboards are taken out of a magazine one by one and then fed to a predetermined position where they are folded or bent to form desired boxes.

In conventional feeding devices it is difficult to feed the plate material accurately, resulting in frequent occurrence of troubles in the process of mass-producing the boxes.

SUMMARY OF THE INVENTION

An object of this invention is to provide a device for feeding plate materials in which a series of plate materials contained in a magazine are successively taken out of the magazine one by one and then fed to a predetermined position accurately.

One of the features of this invention is that engagement projections are provided to the front and rear walls of the magazine outlet so that the rear projection will engage with the outer rear surface of the plate and the front one with the front edge of the plate and that a claw is provided to the front end of the kicker. Because of this construction, as the reciprocating member is advanced, the claw of the kicker engages with the rear end of the plate material on the support surface of the reciprocating member to feed it to the predetermined position and the next plate material in the magazine is prevented from being taken out of the magazine by its engagement with the front and rear projections. This ensures that the plate material being fed is separated from the successive plates.

Another feature is that a friction member is bonded to the upper surface of the kicker so that the successive plates can be brought into frictional engagement with the kicker surface and can be fed one by one out of the magazine to a predetermined position with the aid of the engagement projections.

In another embodiment of this invention, a movable engagement member is provided to the outer side of the front wall of the magazine outlet to prevent the following plates from being taken out of the magazine when the outermost plate on the support surface of the reciprocating member is being fed.

Other objects and features of this invention will become apparent from the following description with reference to the accompanying drawings.

DETAILED DESCRIPTION OF THE PREFERRED EMBODIMENTS

Figure 1:
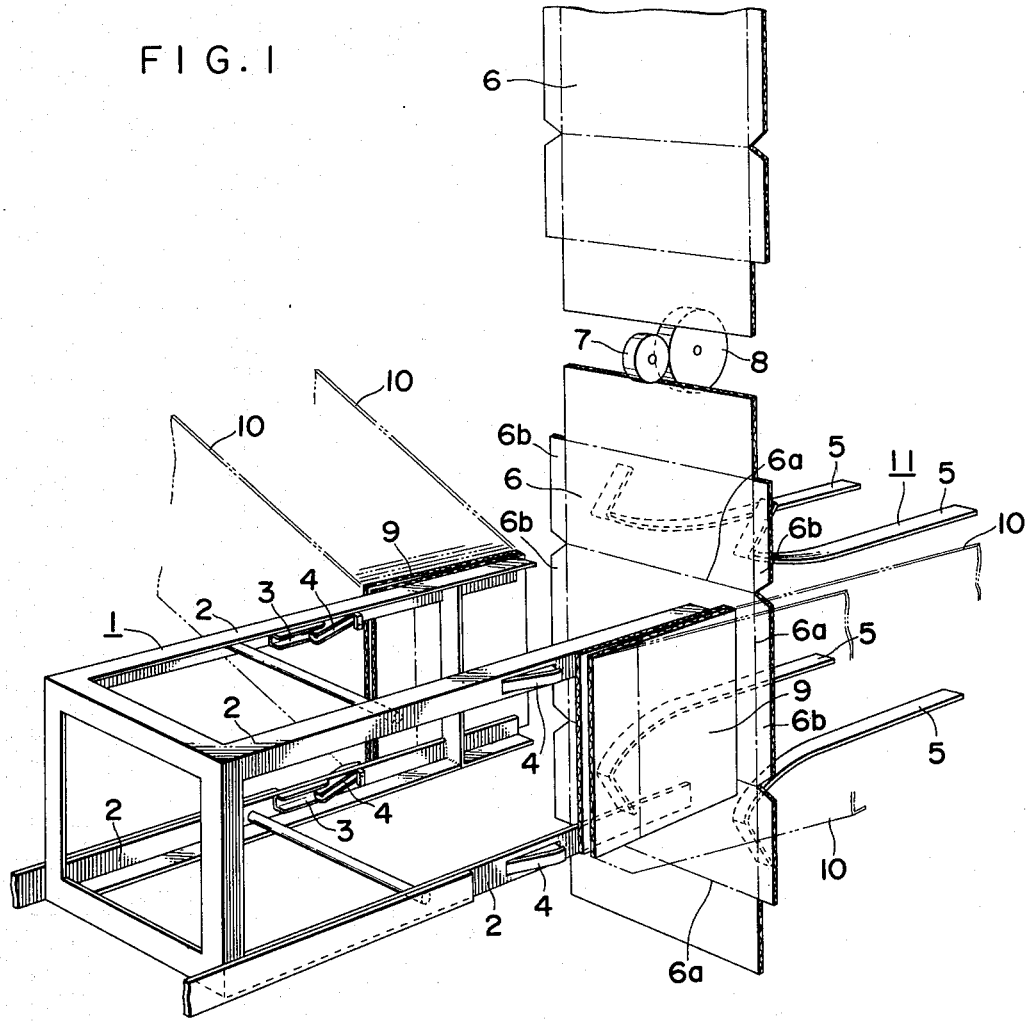
FIGS. 1 and 2 are perspective views of the plate material feeding device of this invention showing the process of forming a box.

Referring to FIG. 1, generally designated by reference numeral 1 is a reciprocating mandrel of a box shape which consists of angle-shaped mandrel members 2 disposed at four corners of the mandrel 1. A kicker 4 is attached to the intermediate portion of each mandrel member 2 through a kicker holder 3.

Four receiver members 5 are disposed in front of the mandrel 1. A series of wrap pieces 6 of plate material are guided and fed successively downwardly between the receiver member 5 and the mandrel 1 by rollers 7, 8. End pieces 9 of the boxes contained in an inclined magazine 10 are supplied to each side of the front portion of the mandrel 1.

Figure 2:
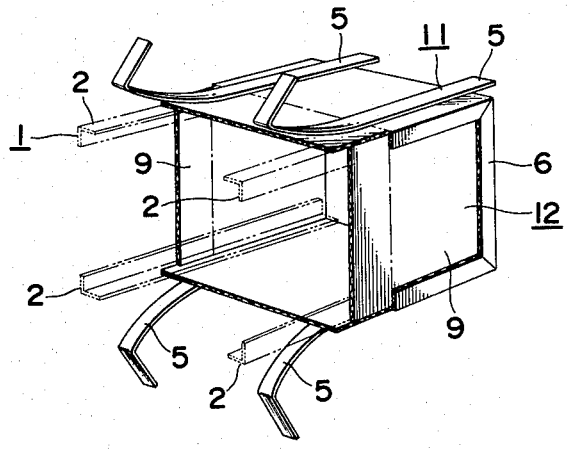

The mandrel 1 is moved back and forth by a drive mechanism not shown. As the mandrel 1 moves forward, the front ends of the mandrel members 2 abut against the surface of the wrap piece 6 and the front end of each kicker 4 pushes the end piece 9 on each side of the mandrel, pressing the front edge of each end piece 9 against the surface of the wrap piece 6. Further forward movement of the mandrel 1 causes the wrap piece 6 to be pushed into a frame 11 made up of the receiver members 5. As the wrap piece 6 is forced into the frame 11, it is folded along folding lines **6*a* and the two end pieces 9 are bonded to flaps 6*b* of the wrap piece 6 which are preapplied with paste. Then, a box 12 is obtained as shown in FIG. 2**.

Figure 3:
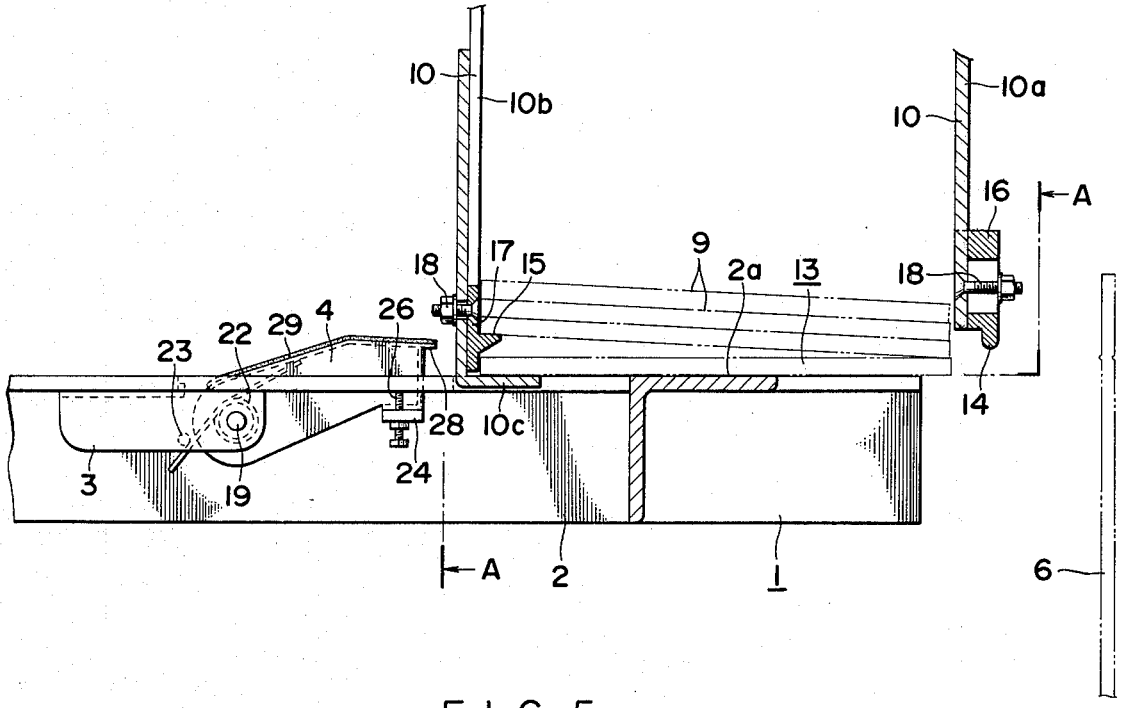
FIG. 3 is a horizontal cross section of a part of the device.
Figure 5:
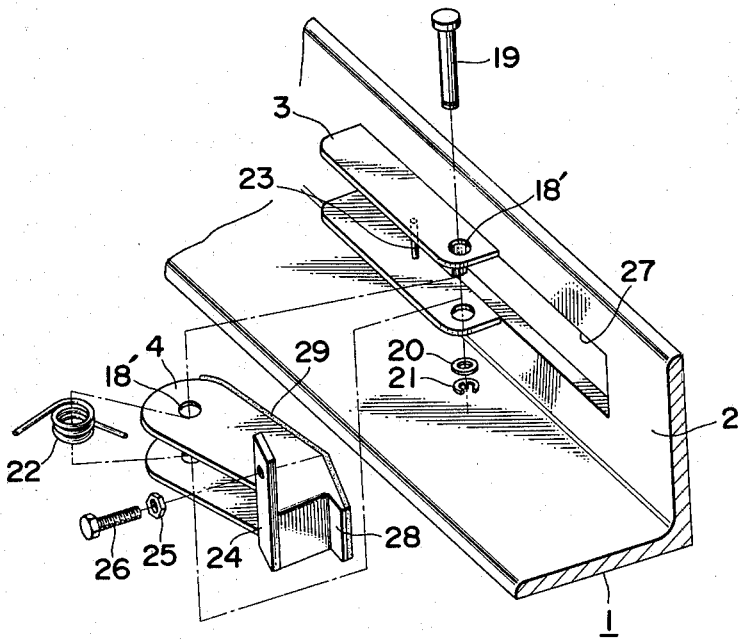
FIG. 5 is a perspective view of a part of the device disassembled.
Figure 4:
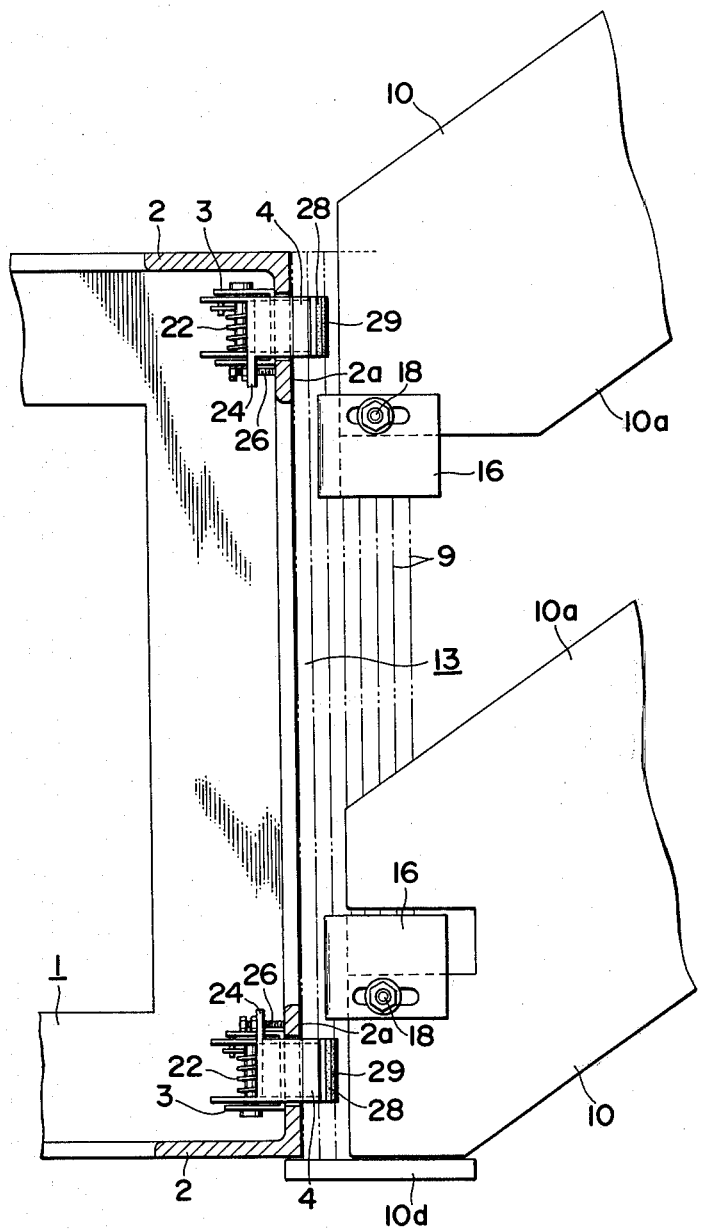
FIG. 4 is a cross section taken along the line A—A of FIG. 3.

The magazine 10, a means for supplying the end pieces 9, is constructed as shown in FIGS. 3 through 5. That is, the magazines 10 in which the end pieces 9 are contained are fixed to a base not shown, and inclined downwardly toward each side of the mandrel. The magazine 10 has an outlet 13 at the lower end. Front and rear walls **10*a*, 10*b* of the magazine 10 have a gap adjusting block 16 with a projection 14 and a sheet separating block 17 with a projection 15, these two blocks being fastened to the walls of the magazine with bolts and nuts 18. A restricter plate 10*c* is provided at the rear portion of the outlet 13 of the magazine 10 and a guide plate 10*d* is provided along the lower end portion of the outlet 13**.

Since the magazine 10 containes a number of end pieces 9, they are urged downwardly toward the outlet 13 of the magazine 10 by their own gravity. The lowest or outermost end piece 9 at the outlet 13 is supported at its front outer surface by the support surface **2*a* of the mandrel member 2 and, at the rear outer surface, engages with the projection 15 of the sheet separating block 17**.

Two pairs of front and rear blocks 16, 17 corresponding to the four kickers 4 on the mandrel members 2 are fitted to the upper and lower portions of the walls of the magazine 10. The mandrel members 2 have the kicker holder 3 each on their back. A shaft 19 is passed through holes 18' made through the kicker holder 3 and the rear portion of the kicker 4. The shaft 19 is secured by a washer 20 and E-ring 21. The shaft 19 has a coil spring 22 fitted therearound with one end of the coil spring 22 engaging with the back of the kicker 4 and the other end with an engagement pin 23 provided to the kicker holder 3. This spring 22 urges the kicker 4 to rotate toward the front side of the mandrel member 2 about the shaft 19. A stopper bolt 26 is screwed through a nut 25 into a support plate 24 vertically projecting from the back side of the kicker 4 so that the kicker 4 is rotatable over a certain range and the front portion of the kicker 4 is always projected above the support surface 2*a* of the mandrel member 2 through an opening 27 cut in the mandrel member 2.

The kicker 4 has a claw 28 projecting from the front end of the outer surface and also has a friction member 29 bonded to the outer surface.

With this construction, as the mandrel moves back and forth, the kicker 4 also moves with it passing the outlet 13 of the magazine 10. When the mandrel advances, the friction member 29 of the kicker 4 comes into contact with the outer surface of the lowest one of stacked end pieces 9 contained in the inclined magazine 10 and carries with it that end piece 9. This causes the end piece 9 to move forward, bringing the front edge of the end piece into engagement with the projection 14 and releasing the rear end from the projection 15.

As the kicker 4 further advances and moves past the outlet 13, the end piece 9 is pressed against the support surface 2*a* of the mandrel members 2. With the end piece 9 pressed against the support surface 2*a*, when the kicker 4 moves back from the foremost position, the friction member 29 of the kicker 4 is again brough into engagement with the outer surface of the end piece 9 and the kicker 4 this time is pushed by the end piece 9 into the opening 27 inside the support surface 2*a* of the mandrel member 2 against the force of the spring 22. The end piece 9 is then retracted until its rear edge abuts against the front surface of the block 17 outside the projection 15. With the end piece 9 engaging with the rear block, the kicker 4 continues moving back until it returns to the rearmost position. In this way, the kicker 4 completes its first stroke.

Figures 6, 7, 8:
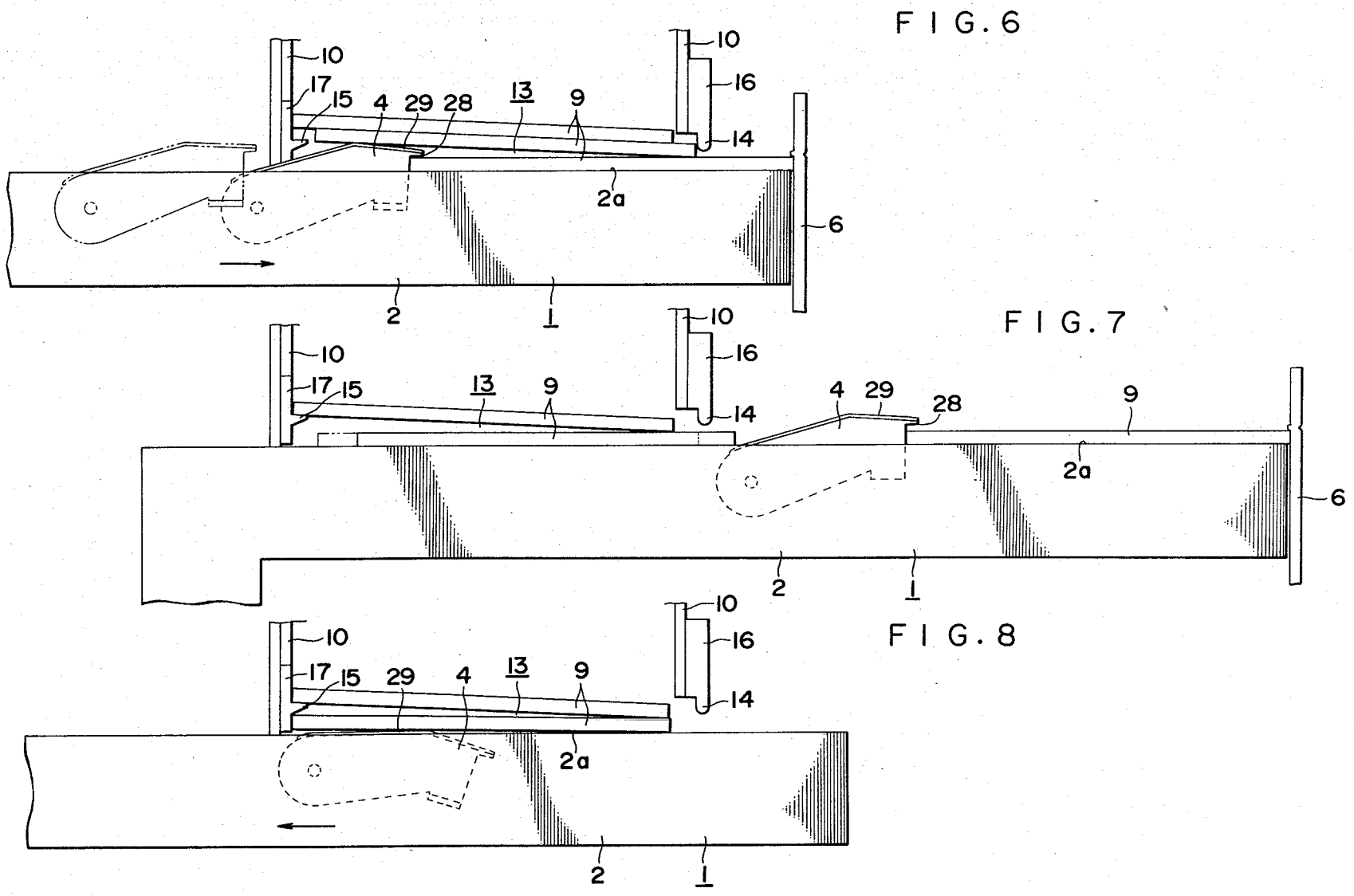
FIGS. 6 through 8 are partial plan views of the device showing the action of the device.
Figure 9:
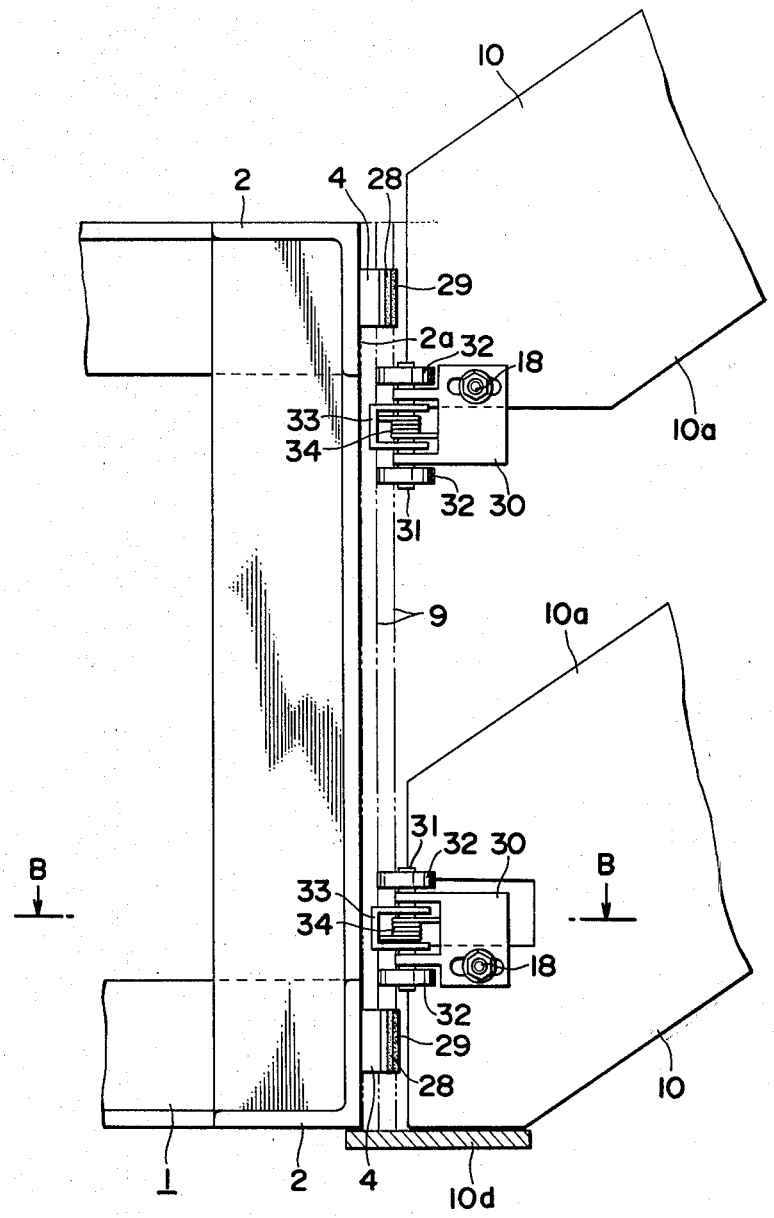
FIG. 9 is a front view of a part of another embodiment according to this invention.
Figure 10:
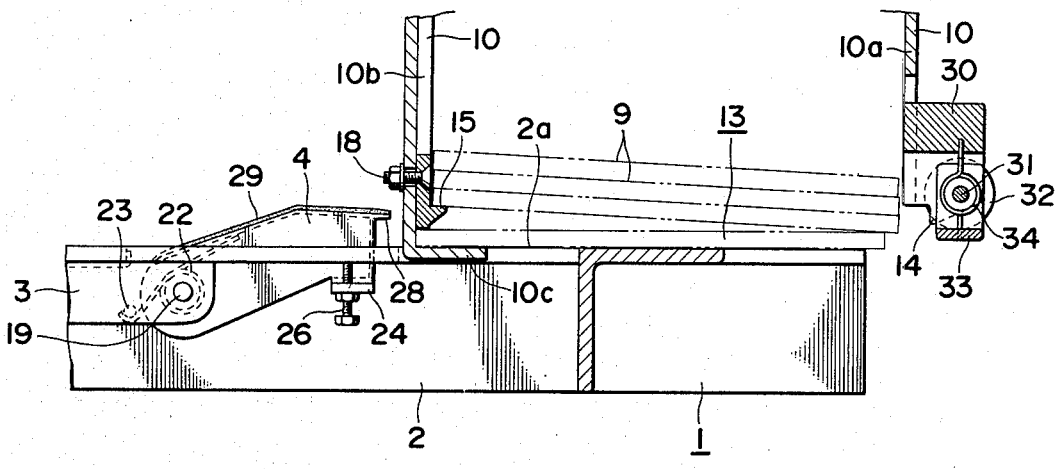
FIG. 10 is a cross section taken along the line B—B of FIG. 9.
Figure 11:
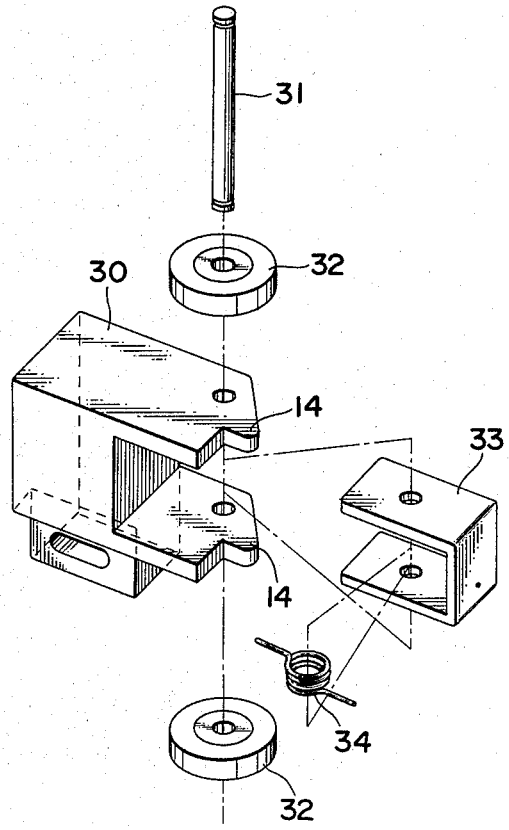
FIG. 11 is a perspective view of a part of the device disassembled.

From the second stroke afterward, each forward movement of the mandrel 1 causes the claw 28 of the kicker 4 to engage, as shown in FIG. 6, with the rear end of the end piece 9 pressed against the support surface 2*a* of the mandrel member 2 and to carry the end piece 9 forward to a predetermined position. By repeating the forward and backward movement of the mandrel 1 as shown in FIGS. 6 through 8, the end pieces 9 contained in the magazine 10 can be taken out of the outlet 13 and fed one by one to the predetermined position.

The device shown in FIGS. 9 through 14 represents another embodiment of this invention. With this embodiment, the block 16 in the preceding embodiment is replaced by a gap adjusting block 30 of different construction.

The gap adjusting block 30 mounted to the front wall 10*a* of the magazine 10 has a shaft 31 passing therethrough with two rollers 32 rotatably supported on the upper and lower ends of the shaft 31. The block 30 also has a U-shaped engagement piece 33 rotatably mounted on the shaft 31 with a coil spring 34 wound around the shaft 31 to restrict the rotation of the piece 33.

Figures 12, 13, 14:
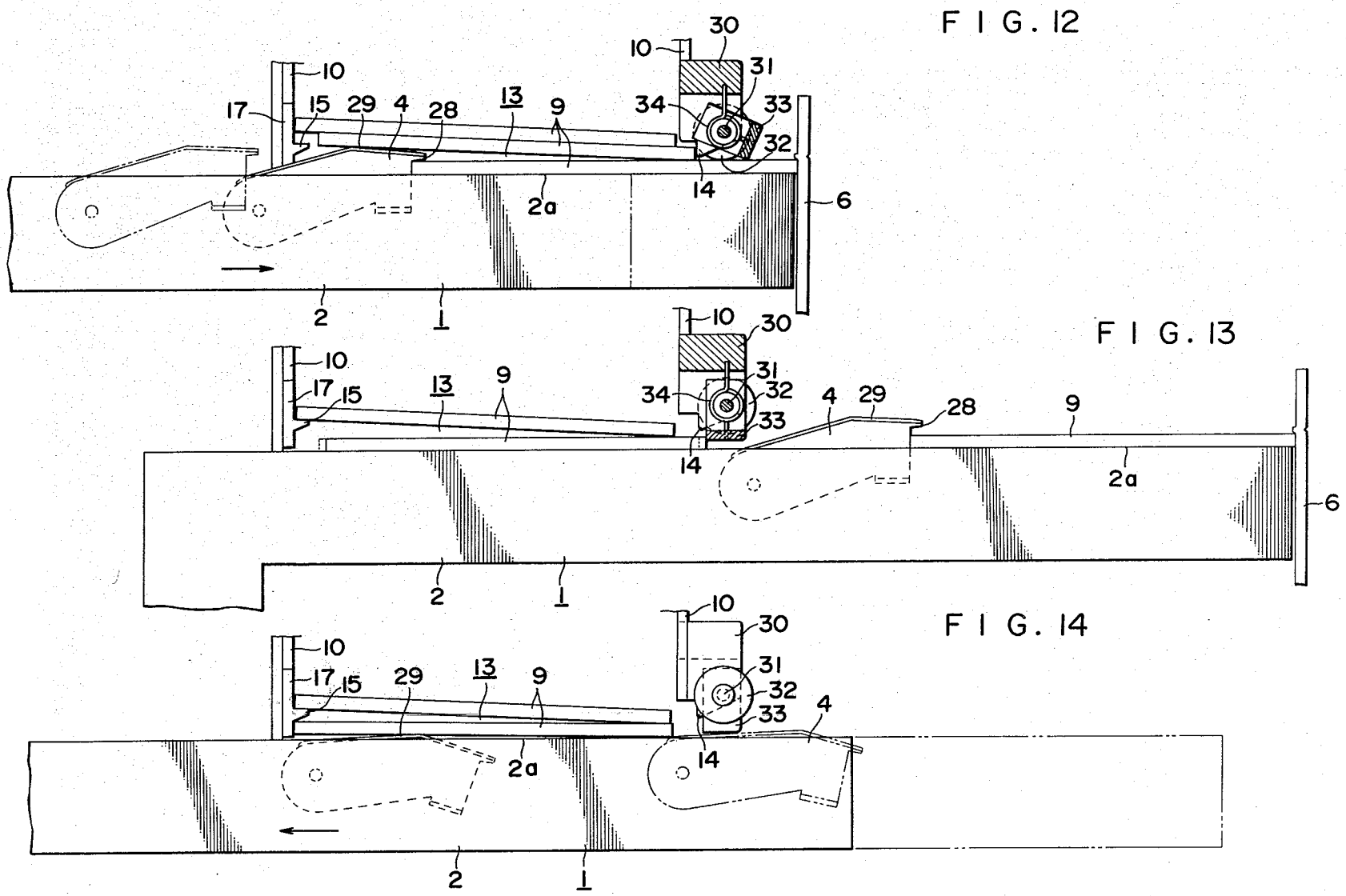
FIGS. 12 through 14 are plan views of a part of the device showing the operation of the device.

In this construction, as the mandrel 1 and therefore the kicker 4 move forward, the end piece 9 is pushed forward by the front end of the kicker 4 and the front end of the end piece 9 abuts against the engagement piece 33, which is then rotated against the force of the coil spring 34. The end piece 9 then advances past the engagement piece 33 as shown in FIG. 12. As the kicker 4 further advances and moves past the engagement piece 33, the engagement piece 33 is rotated backward by the action of the coil spring 34 to the original position, thus blocking the forward movement of the successive end pieces 9.

As the kicker 4 retracts from the foremost position, it is depressed by the engagement piece 33 and the end piece 9 into the opening of the mandrel member 2 below the support surface 2*a* against the force of the spring 22 until it returns to the retracted position. The upper and lower rollers 32 rotate contacting the upper surface of the end piece 9 being fed.

Although in the above two embodiments the end pieces 9 are taken as the material to be supplied in forming the box 12, it should be noted that this invention is not limited to the end piece alone and can be applied to other materials.

What is claimed is:

1. A device for feeding plate materials comprising: a magazine containing a number of stacked plate materials and guiding them toward its outlet, the plate materials being urged in the direction perpendicular to their surfaces; a reciprocating member disposed at the outlet of the magazine in such a manner that it can be moved back and forth to receive the plate members from the outlet of the magazine and carry them one by one on its support surface to a predetermined position, the support surface being disposed to face the outlet of the magazine; a kicker retractably fitted to the reciprocating member through a spring so that, when projected from the support surface of the reciprocating member, the kicer engages with the rear edge of the plate material on the support surface as it advances; a rear engagement projection protruding inwardly from the rear wall of the magazine outlet so that it opposes and engages the outer rear surface of the outermost one of the plate materials contained in the magazine; a front engagement projection protruding from the front wall of the magazine outlet toward the support surface of the reciprocating member so that it opposes the front edge of the outermost one of the plate materials contained in the magazine; and a claw projecting from the front end of the kicker so that it catches the rear edge of the plate material pressed against the support surface of the reciprocating member, said kicker being disposed so that the upper surface of the kicker, as it moves forward, comes into sliding frictional engagement with the underside of the plate material whose rear end is engaging with the rear engagement projection of the magazine and moves the last-recited plate material off of said rear engagement projection of the magazine and into position to be fed out of the magazine and thereafter to be caught and moved by said claw of said kicker.

2. A device for feeding plate materials as set forth in claim 1, wherein the kicker has means with a high coefficient of friction on the upper surface thereof.

3. A device for feeding plate materials as set forth in claim 1, wherein a movable engagement member is supported on a shaft on the front wall of the magazine outlet so that it opposes the front edge of the plate member pressed against the support surface of the reciprocating member.

4. A device for feeding plate materials as set forth in claim 3, wherein the movable engagement member is restricted in its movement by a spring.

* * * * *